US005651708A

United States Patent [19]

Børseth

[11] Patent Number: 5,651,708

[45] Date of Patent: Jul. 29, 1997

[54] ARRANGEMENT FOR BUOY LOADING

[75] Inventor: Knut E. Børseth, Tårnåsen, Norway

[73] Assignee: Maritime Tentech AS, Kristiansand, Norway

[21] Appl. No.: 505,182

[22] PCT Filed: Feb. 14, 1994

[86] PCT No.: PCT/NO94/00038

§ 371 Date: Sep. 8, 1995

§ 102(e) Date: Sep. 8, 1995

[87] PCT Pub. No.: WO94/18065

PCT Pub. Date: Aug. 18, 1994

[30] Foreign Application Priority Data

Feb. 12, 1993 [NO] Norway ..... 930504

[51] Int. Cl.[6] ..... B63B 22/02

[52] U.S. Cl. ..... 441/5; 114/230

[58] Field of Search ..... 441/3–5; 114/293, 114/230; 166/354, 355

[56] References Cited

U.S. PATENT DOCUMENTS 4,604,961 8/1986 Ortloff et al. ..... 114/230

FOREIGN PATENT DOCUMENTS 0371668 6/1990 European Pat. Off. .
0167906 9/1991 Norway .
93/11031 6/1993 WIPO ..... 114/293
WO93/24733 12/1993 WIPO .

*Primary Examiner*—Sherman Basinger
*Attorney, Agent, or Firm*—Kenyon & Kenyon

[57] ABSTRACT

An arrangement for buoy loading of hydrocarbons at sea includes a buoy element (5) which is connected to mooring lines (13) and riser lines (11) and is arranged to be received in a recess (8) in the bottom of the vessel (1) in such a way that the vessel can rotate with respect to the mooring lines (13) and the riser lines (11). An upper turning body (18) is turnably arranged in the vessel (1) spaced above the buoy element (5), and flexible conduits (17,23) extend from the buoy element (5) to resiliently supported connectors in the turning body (18). A swivel (29) is arranged on the turning body (18), one side of which is connected to the connectors and the other side of which is connected to a pipe system of the turning vessel. The turning body (18) is provided with devices (27,28) for turning it in steps with respect to the vessel in order to keep the turning body (18) and the buoy element (5) within a predetermined mutual angular relationship when the vessel turns about the buoy element (5) due to environmental forces.

20 Claims, 1 Drawing Sheet

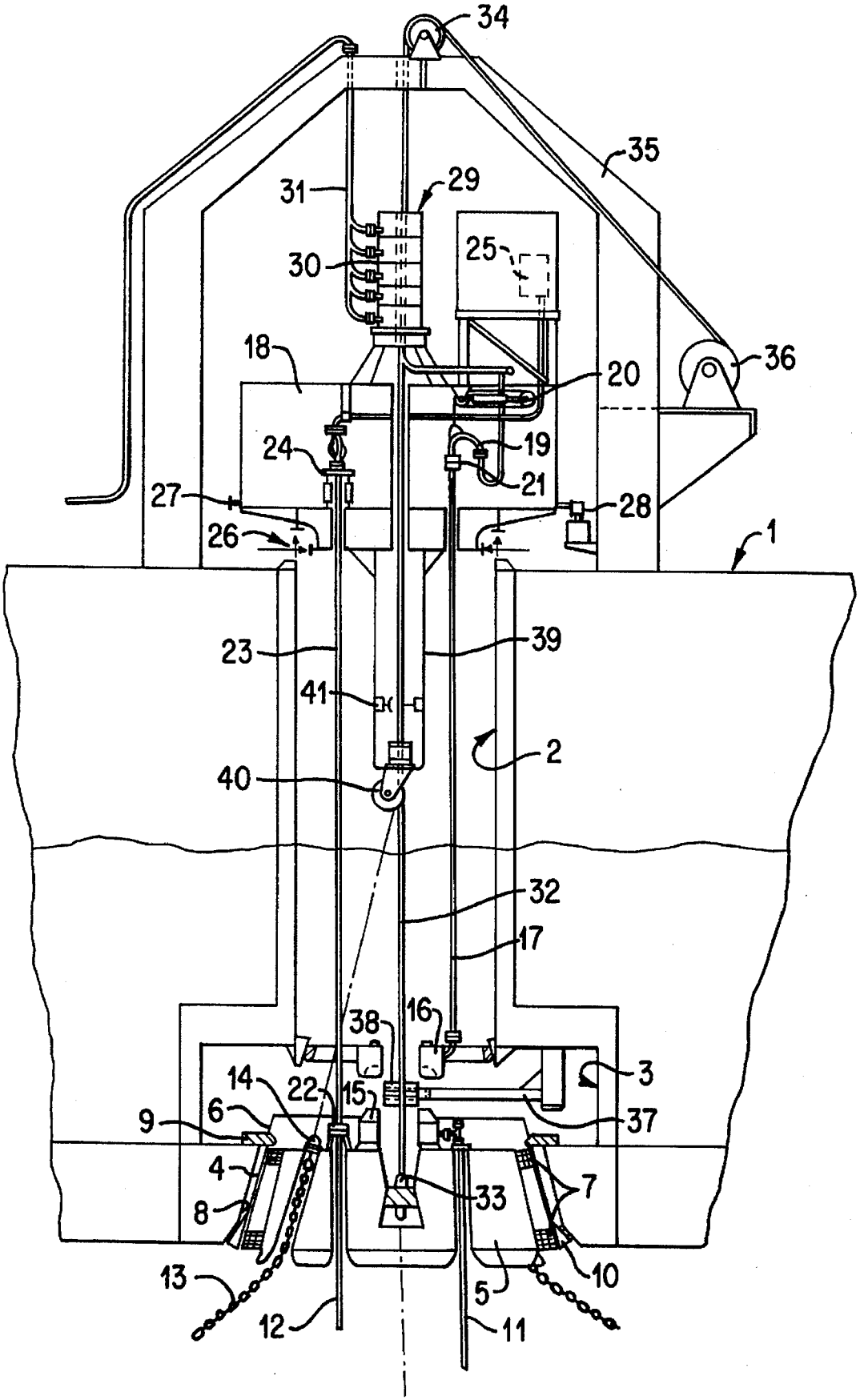
34
35
31
29
30
25
18
20
36
24
19
21
27
28
26
1
23
39
41
2
40
32
17
38
16
3
14
22
15
37
9
6
4
7
8
33
13
10
5
12
11

ARRANGEMENT FOR BUOY LOADING

BACKGROUND OF THE INVENTION

The present invention relates to an arrangement for buoy loading of hydrocarbons at sea, comprising a buoy means which is anchored to the sea floor by means of mooring lines and is connected to at least one riser line and is arranged to be received in a seat in a vessel for rotation with respect to the vessel about a generally vertical axis, said riser line being in flow communication with a lower connector member which is arranged on the buoy means and fitting together with an upper connector member arranged in the vessel, a flow communication being arranged between the upper connector member and one side of a swivel means, the other side of which being connected to a pipe system in the vessel.

Such an arrangement is known, e.g., from Norwegian patent No. 167.906. When used in rough weather areas, e.g., in the North Sea, the vessel will be moving all the time in order to assume the most favourable direction for meeting waves, wind and current. These movements cause frequent movements in the swivel means, which therefore is worn relatively quickly and becomes a critical element as regards the regularity of the arrangement. This problem becomes even greater if one wishes to connect further riser lines or injection lines to the ship because, in that case, the swivel will need more channels and becomes correspondingly complicated.

SUMMARY OF THE INVENTION

One of the objects of the present invention is therefore to provide an arrangement of the introductory type where frequent relative turning movements between the vessel and the buoy means can be allowed without concurrently causing mutual turning between the inlet and outlet sides of the swivel means.

This is obtained according to the invention by an arrangement of the introductory type, which is characterized in that said one side of the swivel means is arranged on a turing body arranged in the vessel spaced above said seat, in that the flow communication between the upper connector member and the swivel means comprises a flexible conduit which is resiliently supported in the turning body, and in that means are arranged for turning the turning body in steps in order to keep the turning body and the buoy means within a predetermined mutual angular relationship when the vessel turns about the buoy means in order to assume the most favourable orientation for meeting waves, wind and current.

The flexible connecting conduit can tolerate a certain twisting due to mutual rotation between the buoy means and the turning body, and the elongation necessitated by this rotation is provided by means of the resilient support of the conduit.

In case there is a desire to run several riser or injection lines via the buoy means, it is suggested according to the invention that each line be attributed its own passage through said lower and upper connector members and its own flexible conduit.

In many cases it will be desirable to connect remotely controlled equipment on the sea floor to a control unit in the vessel by means of a control cable. For this purpose it is suggested according to the invention to let such a connection comprise a resiliently supported control cable which extends between a connector on the buoy means and the turning body.

According to an advantageous embodiment of the invention, the flexible conduit or conduits are provided with a swivel, preferably at their upper end. This facilitates a larger rotation angle between the buoy means and the turning body without the torsion becoming too large in the flexible conduit. Even when using a larger number of conduits, e.g., ten, this will make it possible to obtain a mutual rotation angle of 70° or more before the turning body has to be moved.

In order to facilitate the resilient support of the flexible conduit in the turning body in a simple and reliable manner, it is suggested according to the invention to provide the conduit with a rigid pipe bend which is connected to a tensioning device. This tensioning device may comprise a hydropneumatic line tensioning means, e.g., of the type known in relation to motion compensation of drilling equipment.

An advantage of the buoy loading arrangement of the present type is that when the buoy means is released from the vessel, it may assume an equilibrium position sufficiently below the water surface for it not to be hit and damaged by other vessels, drifting ice or other drifting objects. In order to fetch the buoy means from its passive, submerged position up to the vessel, it is provided with a pull-in hawser, which at one end is releasably attached to the buoy means and which at its other end is engagable with a winch on the vessel, said hawser, upon being released from the buoy means, may be connected to the upper connector member and raise it to a disconnected, parked position in the vessel. In order to facilitate catching the buoy means from the vessel when the buoy means is in its neutral submerged position, the hawser should advantageously be connected to the buoy means in this situation. For catching the hawser or preferably a pull-in line attached thereto from the vessel, the pull-in line must be provided with a surface buoy. Due to its size this buoy cannot without difficulty pass the relatively narrow central opening in the upper connector element and, according to the invention, it is therefore suggested to utilize a split float which is mountable on the hawser or pull-in line in the space between the connector elements when the upper connector element is located in its upper parked position.

In order to ease this operation, a pivotable arm may advantageously be arranged in the vessel for bringing the float to and from the mounted position on the hawser.

Even though the arrangement according to the invention can be used for vessels where the seat for the buoy means is permanent and rotatably arranged in the vessel, it will be particularly advantageous in a version where the buoy means is partly surrounded by an outer body which is arranged to be received in said seat and which is connected to the buoy means by means of preferably watertight bearings, the outer body on its outside being provided with a preferably watertightening fender device. Here, the bearings between the buoy means and the outer body can be made with a relatively large diameter so that the bearing pressure is minimized and the forces from the mooring lines are transmitted without causing large bending moments in the structure of the buoy means.

BRIEF DESCRIPTION OF THE DRAWING

FIG. 1 is a schematic view of an arrangement for a buoy loading according to the present invention.

DETAILED DESCRIPTION

For the better understanding of the invention, it will be described more closely in the following with reference to the example of the invention shown schematically, partly in section, in the appended drawing.

In the drawing a portion is shown of a vessel 1 which is provided with a vertical shaft 2, which at the bottom has an enlarged portion 3 where a seat 4 is formed for a buoy 5 generally having the form of a rotation body.

At the top and sides the buoy 5 is surrounded by an outer body 6, which at the top and at the bottom is pivotally connected to the buoy 5 by means of watertight radial bearings 7. The outer body 6 is received in a recess 8 in the bottom of the vessel 1, where it is fixed by means of horizontally movable locking wedges 9, which may be remotely controlled and made as shown in the above mentioned Norwegian patent No. 167.906 or British patent No. 2.094.738. The outer body 6 is at the bottom provided with a combined fender and watertight packing 10, which abuts the lower circumferential portion of the recess 8 for forming a sealing force transmitting area between the outer body 6 and the vessel 1.

The buoy 5 is provided with passages for riser or injection lines 11, of which only one is shown for reasons of clarity. The buoy also has passages for a control cable 12 and mooring chains 13. The mooring chains are at one of their ends provided with a termination 14, which comprises a gripping eye, a load cell for measuring chain tension and a flange for sealing engagement against a support at the upper end of the respective passage. It will be apparent that the lower end of the chain passages lies very close to the periphery of the buoy. This results in a short force transmission distance to the lower bearing 7 and reduced bending moments in the structure of the buoy. Furthermore, the chain force will have a maximum arm with respect to the rotational axis of the buoy so that only a rather small eccentric tension in the chains will cause the buoy to rotate in its bearings and assume a new position when the vessel turns due to environmental forces. The load cells facilitate continuous monitoring of the chain tension and also have another function to be described in more detail below.

To the top of the buoy is attached the lower member 15 of a connector having several passages, e.g., one for each of the riser lines 11. The upper member 16 of the connector is shown in disconnected parked position. The connector may, e.g., be of the type marketed under the name "Valved Multiported Connector" by Bardex Subsea Corporation, Texas, USA. The riser lines 11 are terminated in the lower connector member 15 and continue out through the upper connector member 16 in the form of a flexible conduit 17, which extends up through the shaft 2 to a turning body 18, where its upper end is provided with a rigid pipe bend 19, which in turn is resiliently supported in a hydropneumatic line tensioning device of a type known to the skilled person. Between the upper end and the flexible conduit 17 and the pipe bend 19 a swivel 21 is inserted.

The control cable 12 ends at the top of the buoy 5 in a connector 22, which may be remotely controlled or manually connectable and disconnectable. From the connector 22 a connecting cable 23 extends up to a resilient support 24 in the turning body 18 and further to a control unit 25.

The turning body 18 is supported by axial and radial bearings 26 for rotation about an axis in common with the buoy 5. The turning body 18 is provided with a toothed rim 27, which is in engagement with a motor driven pinion 28. By means of this arrangement the turning body may be rotated with respect to the vessel 1 to any angular extent and direction desirable.

The turning body 18 is further provided with a swivel device 29, one side of which is connected to the flexible conduits 17 and the other side 30 of which is connected to a pipe system 31 of the vessel.

The turning body 18 and swivel device 29 have a throughgoing central passage which provides room for a pull-in hawser 32, which at one end 33 is releasably attached to the buoy 5 and extends over a pulley 34 at the top of a bridge structure 35 on the vessel and further to a winch 36. The pull-in hawser is used in a manner known per se to pull the buoy 5 into position in the recess 8 after interception of the hawser, which when the buoy is in the disconnected submerged condition, in its other end is provided with a marking float, possibly with a pull-in line inbetween. The float may be intercepted and connected to the winch in several different ways, for instance, as shown in Norwegian patent application No. 93.3444.

If, in an emergency situation, it is desirable to release the buoy from the vessel as quickly as possible, there may be little time for catching the hawser or pull-in line along the side of the vessel and connecting the float thereto before it is completely released. It is therefore suggested according to the invention to make the float in such a manner that it can be closed around the hawser. For this purpose an arm 37 is arranged which may be swung into the space between the lower and upper connector members 15, 16 when the latter is in the upper position. On this arm a holder for the float 38 is arranged, which concurrently holds open a radial split in the float so that it may be moved onto the hawser. Upon releasing of the holder the float will close around the hawser due to internal tension but not so tight that the hawser cannot be pulled down through the float until an enlargement at the end of the hawser comes to abutment against the top side of the float and pulls it along out of the holder.

The pull-in hawser 32 also serves another function. It will be noted that the turning body 18 is provided with a central depending column 39, which at the bottom is provided with a pivotable guide pulley 40. In the column 39 above the guide pulley, a chain stopper 41 is arranged. This arrangement can be used to adjust the tension of the mooring chains 13. This feature is desirable because it is very difficult to deploy the chains absolutely precisely to the respective anchorage points and provide them with the exact length, and they may stretch differently after having been subjected repeatedly to high loads. By means of the load cells in the terminations 14, the chain tension may be registered and form the basis for calculations for how much each chain must be shortened or lengthened in order to obtain correct tension. When these calculations have been performed, each chain is in turn connected to the end 33 of the hawser after it has been freed from the buoy, whereupon the chain is pulled up into the column 39 past the chain stopper 21 and is locked therein. Here the chain may be lengthened or shortened as necessary in a dry environment, whereupon the chain is lowered back in place with the termination 14 in contact with the support on the buoy. It will be understood that the mooring chain 13 does not have to be a chain in its entirety but may have a portion of steel wire or other suitable material. The connection and disconnection of the hawser 32 to the termination 14 of the chain and the attachment point in the buoy 5 preferably take place after the space above the buoy has been emptied of water. However, these operations may be performed without such evacuation, e.g., by means of divers.

The hawser 32 may also be used to raise the upper connector member 16 when disconnecting it from the lower connector member 15 on the buoy 5. Raising the upper connector member may also be done by increasing the tension in the flexible conduits 17, e.g., by means of suitable manipulation of the line tensioning devices 20. Reducing their tension may be used for moving the upper connector member 16 back in place on the lower connector member 15 when these are to be interconnected when the buoy 5 has been received and locked in the recess 8. Before the interconnection the turning body 18 is driven to such a position that the connector members for both the riser lines and the control cable are brought in correct position with respect to each other.

In normal operation the buoy 5 will turn with respect to the vessel 1 when the vessel adjusts itself to the prevailing environmental forces. The turning body 18 will usually remain fixed as long as these movements lie within a predetermined angular interval, e.g., 25°. The mutual turning between the buoy and the turning body is in this situation taken up by the resiliency of the supporting devices 20 and 24 and by the connecting cable 23 and flexible conduits 17 being twisted somewhat. Such twisting may be compensated for by the swivel 21. When the predetermined twisting angle between buoy and turning body is exceeded, the turning body is driven by means of the motor driven pinion 28 to a new position neutralizing the elongation and twisting of the connecting conduits or past the neutral position if the expected turning of the vessel should so indicate. In this way it may be sufficient to drive the turning body 18 only two or three times during each twenty-four hour period. It will be understood that a larger mutual angle than 25° may be accepted dependent upon the ability of the connecting conduits to resist twisting and spacing.

It will be understood that the invention is not limited to the exemplifying embodiment described above but may be varied and modified in a number of ways within the scope of the following claims.

I claim:

1. An arrangement for buoy loading of hydrocarbons at sea, comprising a buoy means which is anchored to the sea floor by means of mooring lines and is connected to at least one riser line and is arranged to be received in a seat in a vessel for rotation with respect to the vessel about a generally vertical axis, said riser line being in flow communication with a lower connector member which is arranged on the buoy means and fitting together with an upper connector member arranged in the vessel, a flow communication being arranged between the upper connector member and one side of a swivel means, the other side of which is being connected to a pipe system in the vessel, wherein said one side of the swivel means is arranged on a turning body arranged in the vessel spaced above said seat so as to be independently rotatable with respect to the buoy means, and wherein the flow communication between the upper connector member and the swivel means comprises a flexible conduit which is resiliently supported in tension in the turning body, and wherein means are arranged for turning the turning body in steps before the turning body and the buoy means exceed a predetermined mutual angular relationship when the vessel turns about the buoy means in order to assume the most favorable orientation for meeting waves, wind and current.

2. An arrangement according to claim 1, wherein the buoy means is connected to several riser lines, each being attributed its own passage through said lower and upper connector members and its own flexible conduit.

3. An arrangement according to claim 2, further comprising a resiliently supported control cable which extends between a connector on the buoy means and the turning body.

4. An arrangement according to claim 2, wherein the flexible conduit is provided with a swivel, preferably at its upper end.

5. An arrangement according to claim 2, wherein the flexible conduit at its resilient support comprises a rigid pipe bend which is connected to a tensioning device.

6. An arrangement according to claim 2, further comprising a pull-in hawser which at one end is releasably attached to the buoy means and which at its other end is engageable with a winch on the vessel, said hawser, upon being released from the buoy means, may be connected to the upper connector member and raise it to a disconnected, parked position in the vessel.

7. An arrangement according to claim 1, further comprising a resiliently supported control cable which extends between a connector on the buoy means and the turning body.

8. An arrangement according to claim 7, wherein the flexible conduit is provided with a swivel, preferably at its upper end.

9. An arrangement according to claim 7, wherein the flexible conduit at its resilient support comprises a rigid pipe bend which is connected to a tensioning device.

10. An arrangement according to claim 7, further comprising a pull-in hawser which at one end is releasably attached to the buoy means and which at its other end is engageable with a winch on the vessel, said hawser, upon being released from the buoy means, may be connected to the upper connector member and raise it to a disconnected, parked position in the vessel.

11. An arrangement according to claim 1, wherein the flexible conduit is provided with a swivel, preferably at its upper end.

12. An arrangement according to claim 11, wherein the flexible conduit at its resilient support comprises a rigid pipe bend which is connected to a tensioning device.

13. An arrangement according to claim 11, further comprising a pull-in hawser which at one end is releasably attached to the buoy means and which at its other end is engageable with a winch on the vessel, said hawser, upon being released from the buoy means, may be connected to the upper connector member and raise it to a disconnected, parked position in the vessel.

14. An arrangement according to claim 1, wherein the flexible conduit at its resilient support comprises a rigid pipe bend which is connected to a tensioning device.

15. An arrangement according to claim 14, wherein the tensioning device may comprise a hydropneumatic line tensioning means.

16. An arrangement according to claim 1, further comprising a pull-in hawser which at one end is releasably attached to the buoy means and which at its other end is engageable with a winch on the vessel, said hawser, upon being released from the buoy means, may be connected to the upper connector member and raise it to a disconnected, parked position in the vessel.

17. An arrangement according to claim 16, wherein a split float is mountable on the hawser in the space between the connector elements when the upper connector element is located in its upper parked position.

18. An arrangement according to claim 17, wherein a pivotable arm is arranged in the vessel for bringing the float to and from the mounted position on the hawser.

19. An arrangement according to claim 16, wherein the buoy means is partly surrounded by an outer body which is arranged to be received in said seat and which is connected to the buoy means by means of preferably watertight bearings, the outer body on its outside being provided with a preferably watertightening fender device.

20. An arrangement according to claim 1, wherein the buoy means is partly surrounded by an outer body which is arranged to be received in said seat and which is connected to the buoy means by means of preferably watertight bearings, the outer body on its outside being provided with a preferably watertightening fender device.

* * * * *

UNITED STATES PATENT AND TRADEMARK OFFICE

CERTIFICATE OF CORRECTION

PATENT NO. : 5,651,708
DATED : July 29, 1997
INVENTOR(S) : Knut E. Borseth

It is certified that error appears in the above-identified patent and that said Letters Patent is hereby corrected as shown below:

| Column | Line | |
|---|---|---|
| 1 | 38 | Change "turing" to --turning--. |

Signed and Sealed this

Tenth Day of February, 1998

*Attest:*

Bruce Lehman

BRUCE LEHMAN

*Attesting Officer*

*Commissioner of Patents and Trademarks*